United States Patent [19]

Chupka

[11] Patent Number: 4,622,132

[45] Date of Patent: Nov. 11, 1986

[54] LIQUID CYCLONE OR CENTRIFUGAL CLEANER

[75] Inventor: David E. Chupka, Middletown, Ohio

[73] Assignee: The Black Clawson Company, Middletown, Ohio

[21] Appl. No.: 725,171

[22] Filed: Apr. 19, 1985

[51] Int. Cl.[4] ..... B04C 3/00; B04C 5/103

[52] U.S. Cl. ..... 209/211; 210/512.1

[58] Field of Search ..... 209/211, 434, 144; 210/787, 788, 512.1; 55/459 A–459 D, 460, 398

[56] References Cited

U.S. PATENT DOCUMENTS

| | | | |
|---|---|---|---|
| 2,468,070 | 4/1949 | Hunter | 210/512.1 |
| 2,816,658 | 12/1957 | Braun et al. | 209/211 |
| 3,912,579 | 10/1975 | Braun | 209/211 |
| 4,153,839 | 5/1979 | Seifert et al. | 209/211 |
| 4,267,048 | 5/1981 | Ohishi | 209/211 |
| 4,378,289 | 3/1983 | Hunter | 209/211 |
| 4,539,105 | 9/1985 | Metcalf | 209/211 |

FOREIGN PATENT DOCUMENTS

| | | | |
|---|---|---|---|
| 869177 | 1/1942 | France | 209/144 |
| 528121 | 12/1976 | U.S.S.R. | 209/434 |
| 710648 | 1/1980 | U.S.S.R. | 209/211 |
| 893272 | 12/1981 | U.S.S.R. | 209/211 |
| 969324 | 11/1982 | U.S.S.R. | 209/211 |
| 1018719 | 5/1983 | U.S.S.R. | 209/211 |

*Primary Examiner*—S. Leon Bashore
*Assistant Examiner*—Thomas M. Lithgow
*Attorney, Agent, or Firm*—Biebel, French & Nauman

[57] ABSTRACT

A cleaner for treating a liquid suspension of mixed relatively heavy and light particles to separate such particles from each other comprises parallel top and bottom plates, an outer wall, and an interior spiral wall cooperating with the outer wall to define a spiral passage having a plurality of turns and leading to an outlet port for heavy particles in the bottom plate. An inlet port delivers the suspension to the outer end of the spiral passage, and there is a second outlet port through one of the top and bottom plates for that portion of the suspension which includes the relatively light particles. Different arrangements of outlet ports are shown to provide for use of the cleaner for forward, reverse, through flow and three-way cleaning action.

10 Claims, 7 Drawing Figures

LIQUID CYCLONE OR CENTRIFUGAL CLEANER

BACKGROUND OF THE INVENTION

Liquid cyclones have been used for many years for the treatment of liquid suspensions of particulate materials to separate the suspended particles on the basis of their respective specific gravities. Paper making stock is typical of the particulate suspensions which are substantially always subjected to such treatment, often in multiple stages in a series of liquid cyclones or centrifugal cleaners constructed and sized to provide progressively finer and more precise cleaning operations.

A typical cyclone for the relatively coarse cleaning of paper making stock which was developed by applicant's assignee in the early 1950's is shown in U.S. Pat. No. 2,645,346 of 1953 to Staege et al. A centrifugal cleaner for fine cleaning developed more recently by applicant's assignee is shown in U.S. Pat. No. 4,155,839 of 1979 to Seifert et al.

The various forms of apparatus shown in these and many other patents all have the common characteristic that their dimension in the direction in which the suspension flows therethrough is relatively large with respect to their cross sectional dimension. For example, a centrifugal cleaner as small as 3 inches in internal diameter—which is a size widely used in the fine cleaning of paper making stock—has a length of the order of 36 inches, while a liquid cyclone having an inner diameter of 8 inches commonly measures approximately 7 ft. in height not including the reject outlet assembly and its related control valve structure. Large liquid cyclones are correspondingly even larger, e.g. a cyclone having an inner diameter of 20 inches may have an overall height in excess of 13 ft.

SUMMARY OF THE INVENTION

The primary object of the present invention is to provide liquid cyclones and centrifugal cleaners which are suitable for all of the uses to which such devices have been put in the past, and which will be of significantly reduced dimensions, especially in height, as compared with prior art apparatus for the same purposes.

The invention differs structurally from prior art practice primarily in that in the prior art, particle separation in response to the application of centrifugal force is effected while the suspension is traveling from one end of the unit to the other, which necessitates the substantial length of prior art devices. In contrast, the interior of the device of the invention defines a relatively compact spiral path having a plurality of turns in a common plane through which the suspension is forced to flow from the outside of the spiral to outlets located at the axial center of the spiral.

Thus in contrast to the substantial heights of conventional such cleaners, the device of the invention need be not substantially higher than the diameter of its inlet supply pipe. Further, while the devices of the invention are somewhat larger in diameter than conventional units of the same capacity, the increase in diameter is far less than the decrease in height, e.g. a diameter of 37 inches and a height of 13 inches for the outer wall as compared to 14 inches and 7.5 feet for a conventional cleaner of corresponding capacity, i.e. an outer diameter to height ratio of more than 2 as compared with a ratio of the order of 0.16 for the corresponding conventional cleaner.

As pointed out in more detail below, the devices of the invention are readily adaptable to all modes of operation for which liquid cyclones and centrifugal cleaners have been used in the past in the treatment of paper making stock. Tne most widely used of these modes of operation is for the purpose of removing high specific gravity particles as reject while the accepted stock includes as much as possible of the usable fiber, but the device of the invention is equally usable for reverse centrifugal cleaning wherein the good fiber becomes the accepted heavies while the rejected fraction comprises light contaminants. Further, the devices of the invention are usable for flow-through cleaning, with the lights and heavies being discharged through concentric ports at the same end of the cleaner, and for three-way cleaning wherein the heavy and light contaminants are both removed from the accepted stock.

There is no particular significance in the choice of terminology designating these cleaners—other than that the term "cyclone" or "cyclone cleaner" is frequently applied to a relatively large unit for coarse cleaning, while the term "centrifugal cleaner" is more often applied to smaller equipment used for fine cleaning. For convenience, the term "cleaner" is used generically hereinafter.

BRIEF DESCRIPTION OF THE PREFERRED EMBODIMENTS

Figure 1:
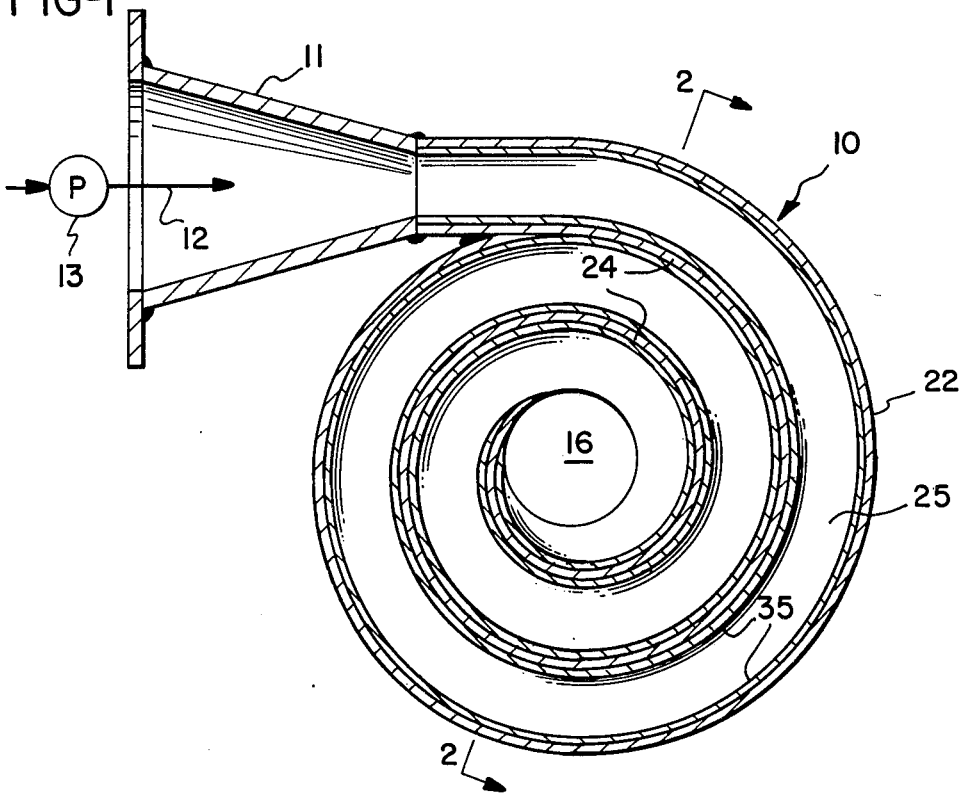
FIG. 1 is a vertical section on the line 1—1 of FIG. 2 showing a cleaner constructed in accordance with the invention.
Figure 2:
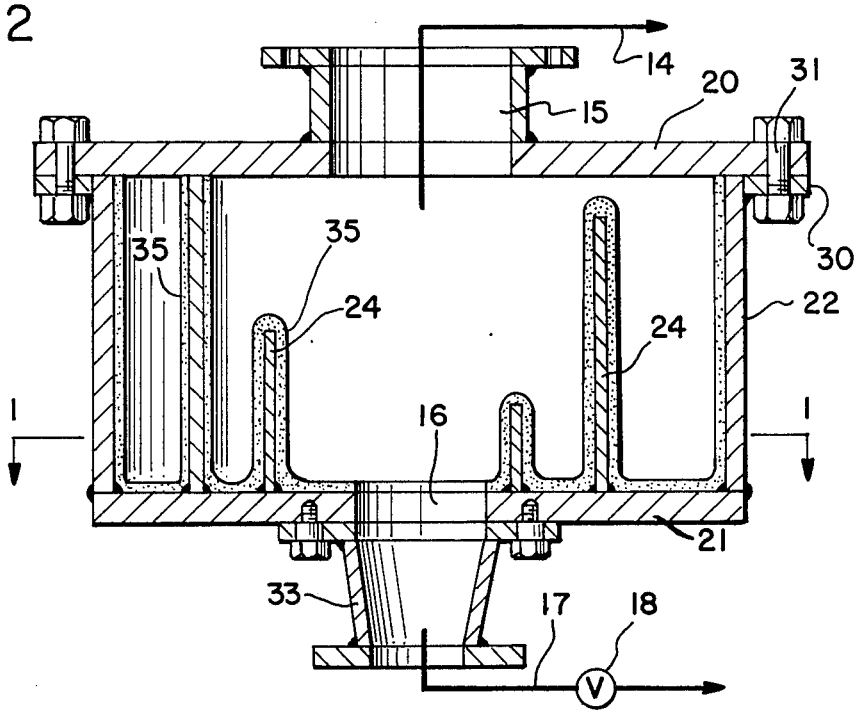
FIG. 2 is a radial section on the line 2—2 of FIG. 1.

FIGS. 1-2 show one embodiment 10 of a cleaner cyclone in accordance with the invention along with fragments of a typical system in which the cyclone 10 constitutes one station. Thus the particulate suspension to be cleaned is supplied to the inlet connection 11 of the cleaner 10 by a line 12 from a pump 13. A line 14 conducts the accepted stock away from the outlet port 15, and the discharge flow from the reject port 16 to a line 17 is controlled by a valve 18.

The cleaner 10 comprises a top plate 20 which includes the outlet port 15, a bottom wall 21 having the outlet port 16 therein, and an outer wall 22 in the form of a portion of a spiral. Inside this outer wall 22 is a further spiral wall 24 of a plurality of turns defining a similar spiral passage 25 of rectangular section leading from the inlet connection 11 to the outlet 16. The outer wall 22 is of uniform height and includes a peripheral flange 30 through which it is connected to the top plate 20 by bolts 31. The bottom wall 21 is shown as welded to outer wall 22, but they could just as well be separate parts having a similar flanged and bolted connection. The outlet port 16 in the bottom wall 21 connects with a fitting 33 bolted to wall 21 and leading to the line 17 and valve 18.

The wall 24 on the interior of the device is of the same height at the inlet end of the spiral passage 25 as the outer wall 22, but it decreases in height as it spirals inwardly of the device until it terminates in a cylindrically curved portion which surrounds a portion of the outlet port 16. At the inlet end of the spiral passage 25, the connection 11 forms a tangential extension of the inlet end of the spiral passage 25, and it is shaped to convert its interior section from a circular form where it connects with the supply pipe 12 to a rectangular form matching the passage 25.

In the operation of this form of the invention for normal centrifugal cleaning, the suspension to be cleaned enters the inlet end of the passage 25 tangentially and is constrained by the outer wall of each turn of this passage to follow a spiral path of decreasing radius. Since its linear flow rate is essentially uniform, its angular flow rate constantly increases as it continues along the passage 25, and the result is to develop the application of constantly increasing centrifugal force on whatever high specific gravity particles are in the suspension. They will therefore follow the inner surface of the walls 22 and 24 until they are guided into the outlet 16.

During travel the length of the spiral passage 25, gravitational force will cause such heavy particles to travel downwardly as well as spirally until they reach and pass through the outlet 16. At the same time, if the flow through outlet port 16 is kept to a relatively low volumetric rate, as by means of valve 18, the major portion of the suspension, including the particles having specific gravities relatively close to that of the liquid component of the suspension will follow a spiral path spaced inwardly from the inner surface of the wall 24 until it is in position to leave the cleaner by way of the port 15 in the top wall 20.

In the simplest form of this device, the passage 25 will be of uniform width to maintain a constant linear flow rate for the suspension, except of course to the extent that there will be a variation in flow rate across the width of the passage due to the difference in radius between its opposed walls. Also, in view of the substantial friction between solid particles in the suspension and the surface of walls 22 and 24 and the bottom of passage 25, those surfaces are preferably provided with a coating 35 of ceramic or other abrasion-resistant material.

Figure 3:
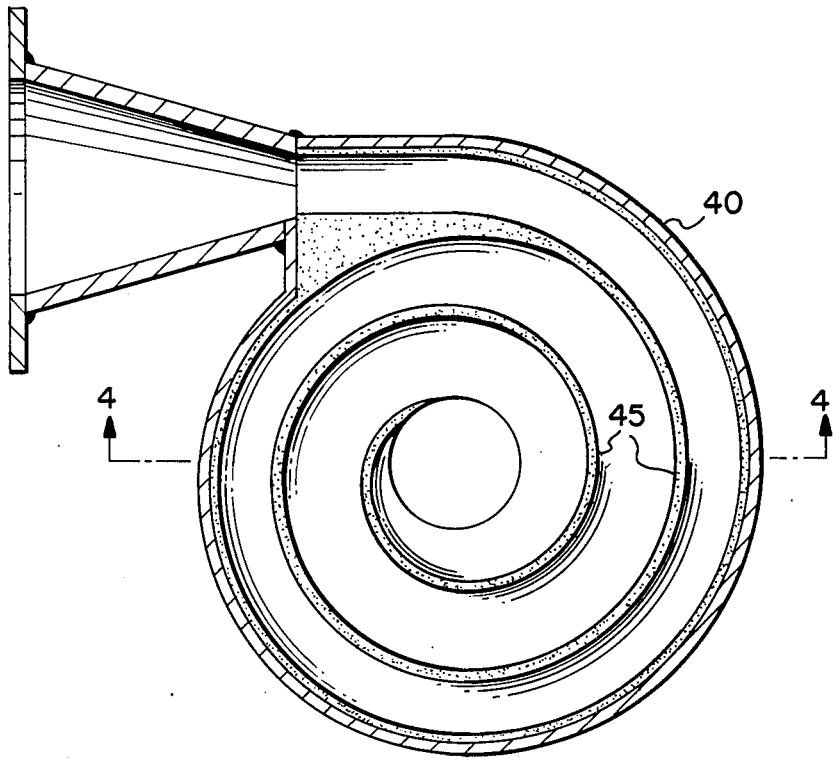
FIG. 3 is a view similar to FIG. 1 showing a modified cleaner in accordance with the invention having a replaceable central part.
Figure 4:
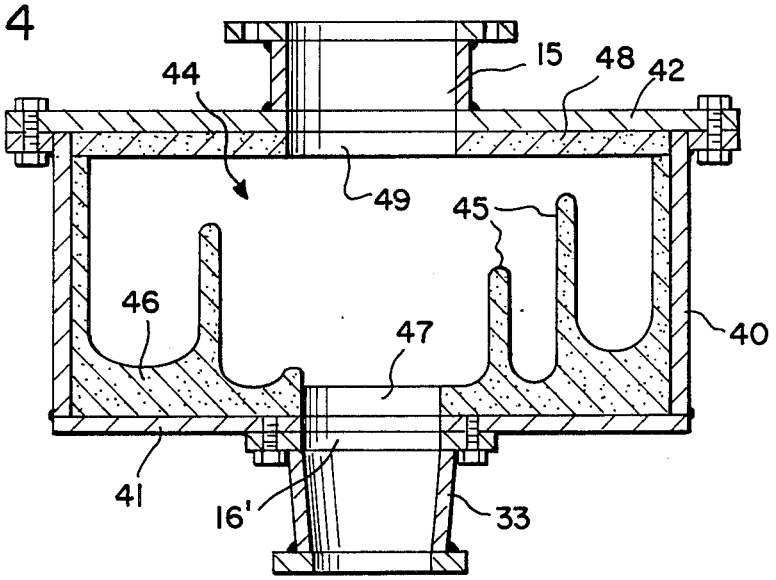
FIG. 4 is a detail view of the replaceable part in FIG. 3 and is taken on the line 4—4 of FIG. 3.

In the alternative construction shown in FIGS. 3 and 4, the outer wall 40 of the body is of steel and includes a bottom wall 41 having a port 16' therethrough, and the top plate 42 may be the same as in FIG. 1. The remainder of the body is a separately formed bowl-like part 44 of ceramic or other abrasion-resistant material, which fits into the outer wall 40 as shown in FIG. 3. The part 44 includes the spiral walls 45, a bottom wall 46 including a port 47, and a separate annular top plate 48 having the port 49 therethrough. This construction has the advantage that the bowl part 44 is expendable and can be replaced in the event of undue abrasion or other damage thereto.

Figure 5:
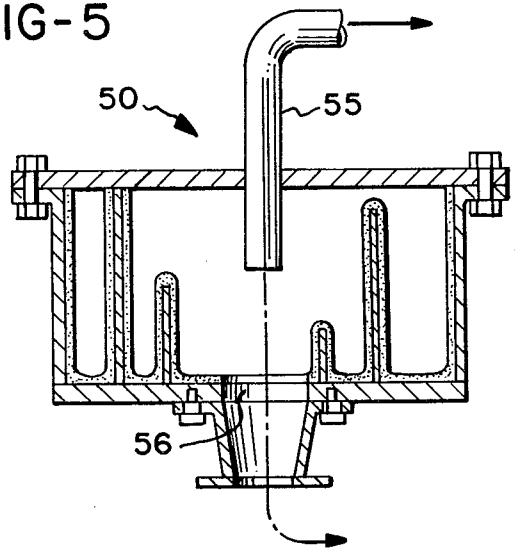
FIG. 5 is a simplified view similar to FIG. 2 and showing a cleaner in accordance with the invention for reverse centrifugal cleaning.

FIGS. 5–8 show cleaners in accordance with the invention which are of the same basic construction as already described, but wherein the port arrangement is modified to provide for different modes of centrifugal cleaning. Thus the cleaner identified generally as 50 in FIG. 5 is shown as having the same overall structure as either of those shown in FIGS. 1–4, but the port arrangement is modified to effect reverse cleaning with only light contaminants being removed through the top port while the remainder of the suspension is discharged through the bottom port.

More specifically, a tube 55 forms the outlet port for lights and extends through the otherwise closed top wall of the cleaner. The other outlet port 56, in the bottom wall of the cleaner, is substantially larger in diameter than the tube 55 so that it can discharge all of the feed suspension which does not exit by way of the tube 55. This form of cleaner in accordance with the invention has direct application to the same uses as described in the above-noted Seifert patent, namely to separate paper making fibers from light contaminants of lower specific gravities, and it is understood that this type of cleaning operation takes place after the suspension has been subjected to conventional centrifugal cleaning to remove at least most of the higher specific gravity contaminants.

Figure 6:
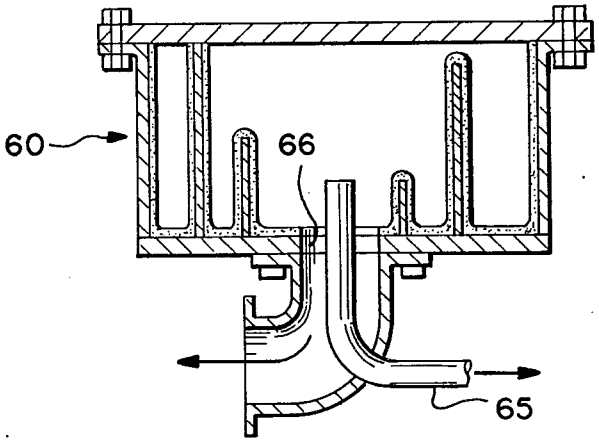
FIG. 6 is a view similar to FIG. 5 showing a flow through cleaner in accordance with the invention.

FIGS. 6 shows a modified form of cleaner in accordance with the invention designed for through-flow cleaning for the same purposes as the cleaner of FIG. 5. In the cleaner 60, the outlet tube 65 for lights is of small diameter and is mounted to extend coaxially through the port 66 through which the rest of the feed suspension discharges, similarly to the operation of the cleaner 50 in FIG. 5. The distinction between these two embodiments of the invention is simply in the location of the lights outlet tube 65 at the same location as the heavies discharge port 66 rather than at the top of the cleaner as in FIG. 5.

Figure 7:
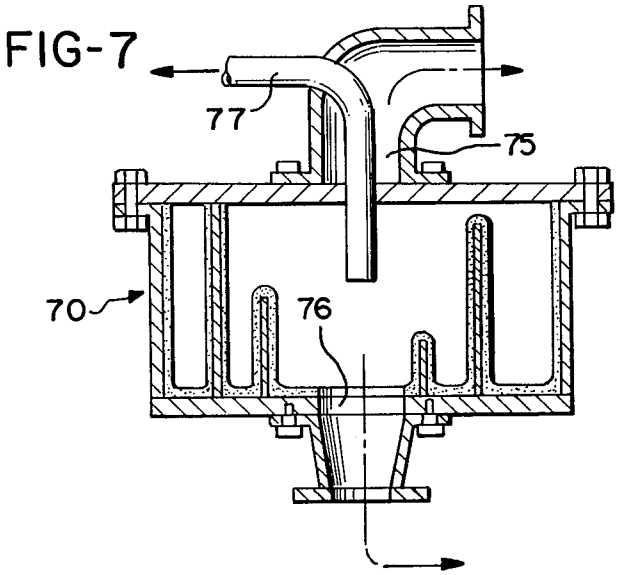
FIG. 7 is a view similar to FIG. 5 showing a three-way cleaner in accordance with the invention.

The cleaner 70 in FIG. 7 has a still other port arrangement designed for three-way cleaning of a feed suspension like paper making stock. The outlet port 75 from the top wall of the cleaner corresponds to the outlet port 15, and the outlet port 76 similarly corresponds to the outlet port 16. A third outlet port, in the form of a tube 77 of small diameter, is mounted to extend coaxially through the outlet port 75. This form of the invention carries out three-way cleaning in that heavy contaminants exit by way of the port 76, the lightest contaminants and air exit by way of tube 77, while the major portion of the feed suspension, including the good fibers and other materials of essentially the same specific gravity, is discharged by way of the top port 75.

All of these different forms of the invention share the same advantages as discussed in connection with FIGS. 1–2, and all of these forms also operate internally in the same manner, the only difference being in the location of the discharge ports and the different selections of discharge flow provided by these different port arrangements.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A cleaner for treating a liquid suspension of mixed relatively heavy and light particles to separate said relatively heavy and light particles from each other, comprising:

(a) a top plate, (b) a bottom plate having a substantially centrally located outlet port therein, (c) a spiral wall including an outer portion cooperating with said plates to form the outer wall of said cleaner and also including a plurality of turns within said outer wall portion and cooperating therewith to define a spiral passage having a corresponding plurality of turns with the inner end thereof communicating directly with said outlet port, (d) means defining an inlet port leading into the outer end of said spiral passage for receiving the suspension to be treated, (e) whereby said suspension is caused to travel through said spiral passage to said inner end thereof and thereby to develop centrifugal force causing heavy particles therein to follow the radially outer wall of said passage to said outlet port, (f) means forming a second substantially centrally located outlet port through one of said plates for receiving the balance of said suspension including the relatively light particles therein, and (g) said portion of said spiral wall within said outer portion being of lesser height than said outer portion to provide space between the top thereof and said top plate through which said balance of the suspension can flow to said second outlet port.

2. A cleaner as defined in claim 1 wherein said spiral wall forming the outer wall of said cleaner is of uniform height, said top and bottom plates are parallel with each other and define the top and bottom of said spiral passage, and said passage is of the same width throughout its length.

3. A cleaner as defined in claim 1 wherein said portion of said spiral wall within said outer wall is of decreasing height from the outer end to the inner end thereof.

4. A cleaner as defined in claim 1 wherein said spiral wall forming the outer wall of said cleaner is of uniform height, said top and bottom plates are parallel with each other and define the top and bottom of said spiral passage, and the ratio of the outer diameter of said outer wall to the height thereof is greater than 2.

5. A cleaner as defined in claim 1 wherein the inside surface of the outer wall and the surface of the spiral wall within the outer wall is formed of abrasion-resistant material.

6. A cleaner as defined in claim 1 comprising means for throttling flow through one of said outlet ports to cause the major portion of said suspension to exit through the other said port.

7. A cleaner as defined in claim 1 wherein said second outlet port is located in said top plate.

8. A cleaner as defined in claim 1 wherein both of said outlet ports are located in concentric relation in said bottom plate.

9. A cleaner as defined in claim 1 wherein said second outlet port is located in said top plate, and further comprising means forming a third outlet port located in concentric relation with said second outlet port for receiving the light fragment of the balance of said suspension.

10. A cleaner as defined in claim 1 further comprising a metallic casing including said top plate, said bottom plate and the outermost portion of said spiral wall, and an insert received within said casing formed of abrasion-resistant material and including the remainder of said spiral wall.

* * * * *